US009266076B2

(12) United States Patent
Kim et al.

(10) Patent No.: US 9,266,076 B2
(45) Date of Patent: Feb. 23, 2016

(54) METHOD AND APPARATUS FOR REAL-TIME FEEDBACK CONTROL OF ELECTRICAL MANIPULATION OF DROPLETS ON CHIP

(75) Inventors: Chang-Jin Kim, Beverly Hills, CA (US); Jian Gong, Los Angeles, CA (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 1421 days.

(21) Appl. No.: 12/513,157

(22) PCT Filed: Nov. 1, 2007

(86) PCT No.: PCT/US2007/083380

§ 371 (c)(1),
(2), (4) Date: Apr. 30, 2009

(87) PCT Pub. No.: WO2008/055256

PCT Pub. Date: May 8, 2008

(65) Prior Publication Data

US 2010/0096266 A1 Apr. 22, 2010

Related U.S. Application Data

(60) Provisional application No. 60/864,061, filed on Nov. 2, 2006.

(51) Int. Cl.
*B01F 13/00* (2006.01)
*B01L 3/00* (2006.01)

(52) U.S. Cl.
CPC ..... *B01F 13/0076* (2013.01); *B01F 13/0071* (2013.01); *B01L 3/502792* (2013.01);

(Continued)

(58) Field of Classification Search
CPC ..... B01F 13/00871; B01F 13/0076; B01L 2200/0605; B01L 2200/143; B01L 2300/0816; B01L 2300/0819; B01L 2300/0864; B01L 2300/089; B01L 2400/0427
USPC ..... 204/602, 600
See application file for complete search history.

(56) References Cited

U.S. PATENT DOCUMENTS 5,422,664 A 6/1995 Stephany
6,565,727 B1 * 5/2003 Shenderov ..... 204/600

(Continued)

FOREIGN PATENT DOCUMENTS

EP 1 0 99 483 A1 5/2001

OTHER PUBLICATIONS

H. Ren, R.B. Fair, M.G. Pollack. "Automated on-chip droplet dispensing with volume control by electro-wetting actuation and capacitance metering" Sensors and Actuators B, vol. 98, 2004, pp. 319-327.*

(Continued)

*Primary Examiner* — Luan Van
*Assistant Examiner* — Louis Rufo
(74) *Attorney, Agent, or Firm* — Vista IP Law Group LLP

(57) ABSTRACT

A device for generating droplets includes a substrate comprising a reservoir site configured to hold a liquid and including a first electrode, a droplet creation site including a second electrode, and droplet separation site disposed between the reservoir site and the droplet creation site and containing an electrode. The device includes control circuitry operatively coupled to the first, second, and third electrodes. The control circuitry is configured to measure the fluid volume on the electrodes and independently adjust an applied voltage to increase/decrease the quantity of fluid. The device can move fluid onto the creation site or back onto to the reservoir site. When the fluid volume is at the desired value or range, a driving voltage is delivered to the first and second electrodes to form a new droplet. The device may generate droplets having a uniform or user-defined size smaller than the electrode.

8 Claims, 8 Drawing Sheets

(52) U.S. Cl.
CPC .... *B01L2200/0605* (2013.01); *B01L 2200/143* (2013.01); *B01L 2300/089* (2013.01); *B01L 2300/0816* (2013.01); *B01L 2300/0819* (2013.01); *B01L 2300/0864* (2013.01); *B01L 2400/0427* (2013.01)

(56) References Cited

U.S. PATENT DOCUMENTS

| | | | | |
|---|---|---|---|---|
| 6,719,211 | B2 * | 4/2004 | Takeuchi et al. | 239/102.2 |
| 6,949,176 | B2 | 9/2005 | Vacca et al. | |
| 2004/0211659 | A1 * | 10/2004 | Velev | 204/164 |
| 2004/0237657 | A1 | 12/2004 | Xie et al. | |
| 2006/0194331 | A1 * | 8/2006 | Pamula et al. | 436/150 |

OTHER PUBLICATIONS

PCT International Preliminary Report on Patentability (Chapter I of the Patent Cooperation Treaty) for PCT/US2007/083380, Applicant: The Regents of the University of California, Form PCT/IB/326 and 373, dated May 14, 2009 (8 pages).

Pollack, Michael G., et al., Electrowetting-based actuation of liquid droplets for microfluidic applications, Appl. Phys. Lett., vol. 77, No. 11, pp. 1725-1726, Sep. 11, 2000.

Lee, Junghoon, et al., Addressable Micro Liquid Handling by Electric Control of Surface Tension, Micro Electro Mechanical Systems, 2001, MEMS 2001. The 14th IEEE International Conference (2001).

Ren, Hong et al., Micro/Nano Liter Droplet Formation and Dispensing by Capacitance Metering and Electrowetting Actuation, IEEE-Nano, pp. 369-372, Aug. 28, 2002.

Fair, R.B., et al., Electrowetting-based On-Chip Sample Processing for Integrated Microfluidics, IEEE Inter.Electron Device Meeting (IEDM) 2003.

Ren, H., et al., Automated on-chip droplet dispensing with volume control by electro-wetting actuation and capacitance metering, Sensors and Actuators B:98 (2004) 319-327.

Chen, Jian Z., et al., Capacitive sensing of droplets for microfluidic devices based on thermocapillary actuation, Lab Chip, 2004, 4, 473-480.

Gong, Jian, et al., Two-Dimensional Digital Microfluidic System by Multi-Layer Printed Circuit Board, Micro Electro Mechanical Systems, 2005, MEMS 2005, 18th IEEE International Conference, Feb. 3, 2005.

Srivastava, Nimisha, et al., Electronic drop sensing in microfluidic devices: automated operation of a nanoliter viscometer, Lab Chip, 2006, 6, 744-751.

Gong, Jian, et al., Characterization and Design of Digitizing Processes for Uniform and Controllable Droplet Volume in Ewod Digital Microfluidics, Solid-State Sensor, Actuator and Microsystem Workshop, Jun. 5, 2006.

PCT International Search Report for PCT/US2007/083380, Applicant: The Regents of the University of California, Form PCT/ISA/210 and 220, dated Jun. 4, 2008 (6 pages).

PCT Written Opinion of the International Search Authority for PCT/US2007/083380, Applicant: The Regents of the University of California, Form PCT/ISA/237, dated Jun. 4, 2008 (4 pages).

Cho, Sung Kwon et al., Towards Digital Microfluidic Circuits: Creating, Transporting, Cutting and Merging Liquid Droplets by Electrowetting-Based Actuation, Mechanical and Aerospace Engineering Department, University of California, Los Angeles (UCLA), Los Angeles, CA 90095, U.S.A, 2002, IEEE, pp. 32-35.

* cited by examiner

METHOD AND APPARATUS FOR REAL-TIME FEEDBACK CONTROL OF ELECTRICAL MANIPULATION OF DROPLETS ON CHIP

REFERENCE TO RELATED APPLICATION

This Application is a U.S. National Stage filing under 35 U.S.C. §371 of International Application No. PCT/US2007/083380, filed Nov. 1, 2007, which claims priority of U.S. Provisional Patent Application No. 60/864,061 filed on Nov. 2, 2006. The contents of the aforementioned applications are incorporated by reference as if set forth fully herein. Priority to the aforementioned application is hereby expressly claimed in accordance with 35 U.S.C. §§119, 120, 365 and 371 and any other applicable statutes.

FEDERALLY-SPONSORED RESEARCH AND DEVELOPMENT

This invention was made with Government support under NCC2-1364 awarded by the National Aeronautics and Space Administration. The Government has certain rights in the invention.

FIELD OF THE INVENTION

The field of the invention generally relates devices and methods for generating droplets on a microfluidic platform operated by electrical manipulation such as electrowetting-on-dielectric (EWOD). More specifically, the field of the invention relates to feedback devices and methods for generating droplets having uniform or controlled volumes.

BACKGROUND OF THE INVENTION

Microfluidic systems have found application in various technical fields including biotechnology, chemical processing, medical diagnostics, energy, electronics, and others. Often, microfluidic systems are developed by the technologies of microelectromechanical systems (MEMS) and implemented on various substrates using the fabrication methods similar to those for integrated circuitry. Such systems have been developed for applications including, for example, analysis and detection of polynucleotides or proteins, analysis and detection of proteins, assays of cells or other biological materials, and PCR (polymerase chain reaction amplification of polynucleotides). These systems are commonly referred to as lab-on-a-chip devices.

Various systems and methods of manipulating the fluids within a microfluidic system have been devised and disclosed. Several examples of mechanical mechanisms that have been used include piezoelectric, thermal, shape memory alloy, and mechanical positive displacement micropumps. These types of pumps utilize moving parts which may present problems related to manufacturability, complexity, reliability, power consumption and high operating voltage.

Fluid handling devices without moving parts have also been utilized. Examples of such systems have used devices which manipulate fluids using electrophoresis, electroosmosis, dielectrophoresis, magnetohydrodynamics, and bubble pumping. Electrokinetic mechanisms (i.e., electrophoresis and electroosmosis) are limited because certain operating liquids contain ionic particles. Moreover, they require high voltage and high energy dissipation, and are relatively slow. Likewise, magnetohydrodynamics and thermal bubble pumping require relatively high power to operate.

Handling of fluids in discrete volumes with a microfluidic system has also been reported. Often called digital microfluidics or droplet microfluidics, this approach of handling fluids, mostly as liquid droplets in air or in oil and rarely as gas bubbles in liquid, popularly uses the principle of electrowetting. Electrowetting refers to the principle whereby the surface wetting property of a material (referred to herein as "wettability") can be modified between various degrees of hydrophobic and hydrophilic states by the use of an electric field applied to the surface.

Electrowetting on a dielectric-coated conductive layer has been used because of its reversibility and has been termed electrowetting-on-dielectric or "EWOD" systems. The EWOD device operates to manipulate fluid droplet by locally changing the surface wettability of the electrowetting surface in the vicinity of the fluid by selectively applying voltage to electrodes under a dielectric film in the vicinity of the fluid. The change in surface wettability causes the shape of the droplet to change. For example, if an electrical potential is applied to an electrode adjacent to the location of the droplet, thereby causing the surface at the adjacent location to become more hydrophilic, then the droplet will tend to be pulled toward the adjacent location. As another example, if voltages are applied to electrodes on two adjacent sides of a droplet, the adjacent surfaces tend to pull the droplet apart, and under proper conditions, the droplet can be divided into two separate droplets.

These electrowetting dynamics can be used to manipulate liquids in several useful ways, including creating a droplet from a liquid reservoir, moving a droplet, dividing or cutting a droplet, and mixing or merging separate droplets. With the ability to controllably perform these types of functions on liquid droplets, a useful microfluidic system is realized.

However, similar fluid manipulations can be obtained, on a similar or often the same device, by other but related actuation mechanisms such as electrostatic and dielectrophoresis (DEP).

For the droplet or digital microfluidic systems to operate effectively, droplet volume uniformity is essential. Attempts to use electrical switching circuitry without feedback can generate droplets with some reasonable accuracy, but it cannot overcome the random errors that are created by the chips and operating conditions. Attempts have been made in some devices to integrate feedback controls with real-time volume detection and signal changing to dispense uniform droplets such as those disclosed in U.S. Pat. Nos. 5,422,664 and 6,719,211. Still others have proposed a feedback control scheme that dispenses liquid on chip using capacitance measurement that is on chip but an external pump connected from off chip. See H. Ren, R. B. Fair, and M. G. Pollack, "Automated on-chip droplet dispensing with volume control by electrowetting actuation and capacitance metering," Sensors and Actuators V, Vol. 98, pp. 319-327 (2004).

There is a need, however, for a feedback control system integrated with the pumping on chip, where the generation of uniform volume droplets may be controlled on-chip without the need for external means. A preferred system would employ an "on-chip" feedback system using relatively small and portable electronic circuitry that avoids large and bulky external components. The control system should be rapid enough to permit real-time feedback control so that the droplet volume may be precise. The control system should be all electronic and reprogrammable so that changes may be made "on the fly" to control drop size.

SUMMARY

In one aspect of the invention, a device for generating droplets includes a substrate comprising a reservoir site configured to hold a liquid and comprising a first electrode, a droplet creation site comprising a second electrode, and a droplet separation site comprising a third electrode disposed between the reservoir site and the droplet creation site. The device includes control circuitry operatively coupled to the first, second, and third electrodes, the control circuitry configured to measure the droplet volume (via capacitance measurements) of at least the second electrode, the control circuitry further being configured to independently adjust an applied voltage to the first, second, and/or third electrodes based at least in part on the measured droplet volume. The control circuitry may be configured to adjust the voltage of the second electrode to maintain a target droplet volume. The reservoir site may include a droplet that is subsequently split. It should be understood that the reservoir may be isolated, containing a droplet of wide volume range, or may be communicating with an input source on or off chip. If the reservoir is small enough, generation of a droplet from the reservoir is equivalent to splitting a droplet into two. It should also be understood that the first, second, and third electrodes may include a group or set of multiple electrodes. It should further be understood that, although the invention is written primarily for a liquid droplet in air, the same invention applies to a liquid droplet in any immiscible fluids (e.g., water in oil) as well as a gas bubble in a liquid.

In another aspect of the invention, a device for generating droplets includes a substrate comprising a reservoir site configured to hold a liquid and comprising a first electrode, a droplet creation site comprising a second electrode, and a droplet separation site comprising a third electrode. The device further includes control circuitry operatively coupled to the first, second, and third electrodes, the control circuitry configured to measure the droplet volume (via capacitance) of at least the second electrode while simultaneously being configured to independently adjust an applied voltage to one or more of the first, second, and third electrodes based at least in part on the measured droplet volume, wherein when a driving voltage is applied to the first electrode fluid is drawn toward and onto the first electrode, when a driving voltage is applied to the second electrode fluid is drawn toward and onto the second electrode, and when a driving voltage is applied to the third electrode fluid is drawn onto the third electrode. The device permits real-time adjustment of the putative droplet size to permit droplet generation of uniform sizes (e.g., volumes). Alternatively, the feedback system may be used to generate droplets having a user-defined size. This user-defined size includes droplets having sizes that are much smaller than the associated electrode.

In still another aspect of the invention, a method of forming droplets in a microfluidic device is disclosed. The device includes a reservoir site configured to hold a liquid and comprising a first electrode, a droplet creation site comprising a second electrode, a droplet separation site comprising a third electrode, and control circuitry operatively coupled to the first, second, and third electrodes. The method includes applying a first set of applied voltages via the control circuitry to one or more of the first, second, and third electrodes, wherein the first set of applied voltages pulls fluid onto the second electrode. A parameter indicative of the fluid volume (e.g., capacitance) of the first and/or second electrodes is measured using the control circuitry. The parameter indicative of the fluid volume is compared against a target and a second set of voltages are applied via the control circuitry to at least the first electrode if the parameter indicative of the fluid volume exceeds the target, wherein the second set of applied voltages pulls fluid onto the first electrode. If the parameter indicative of the fluid volume is less than the target, a second set of voltages is applied via the control circuitry to at least the second electrode, wherein the second set of applied voltages draws more fluid onto the second electrode. The measurement and comparison may be repeated a plurality of times. If the parameter indicative of droplet volume is at the target, both the first and second electrodes are driven to form a droplet. The liquid held at the reservoir site may include a droplet that is subsequently split.

In another embodiment of the invention, a method of mixing solutions in a microfluidic device is disclosed. The device includes at least first and second solutions and a plurality of electrodes, the plurality of electrodes being operatively coupled to control circuitry for substantially and simultaneously applying driving voltages and measuring capacitance values. The method includes forming a reduced volume droplet of the first solution on one of the plurality of electrodes, the reduced volume droplet having a size that is less than the size of the electrode. A droplet of the second solution is formed on one or more of the plurality of electrodes, the droplet having a size that is similar to or larger than the size of the electrode. The two droplets are then mixed. The mixed droplet is then split into multiple droplets. Another droplet of the second solution is formed and mixed with one of the split droplets. This mixed droplet may again be split and mixed with another droplet of the second solution or the third. The process may be repeated a number of times until a desired mixture is reached. A special case of this mixing is serial dilution of the first solution by the second solution (or additional solutions) with a dilution rate not limited by the electrode size.

BRIEF DESCRIPTION OF THE DRAWINGS

FIG. 7A illustrates initial loading of the device. FIG. 7B illustrates the formation of a small volume droplet and movement of a larger droplet of diluting fluid. FIG. 7C illustrates mixing of the smaller and larger droplets. FIG. 7D illustrates splitting of the mixed droplet into multiple droplets.

DETAILED DESCRIPTION OF THE ILLUSTRATED EMBODIMENTS

Figure 1:
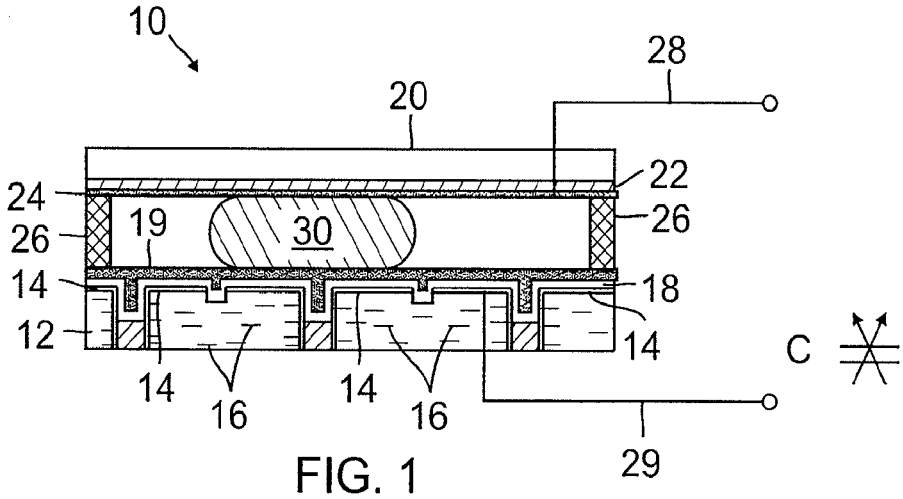
FIG. 1 illustrates a cross-sectional view of a type EWOD chip having an independent electrical access to each electrode of a packed collection of electrodes on a two-dimensional surface. Also illustrated are electrical contacts for measuring the capacitance of the upper and lower electrodes.

FIG. 1 schematically illustrates a cross-sectional view of a microfluidic device 10 that can be used in accordance with the invention. The microfluidic device 10 may include an electrowetting-on-dielectric (EWOD) based device 10. For example, the microfluidic device 10 may include an EWOD chip. As seen in FIG. 1, the EWOD chip 10 is made of a substrate 12 that may have one layer or multi-layer electric lines in it, printed circuit board (PCB) being one example. The substrate 12 includes a number of electrodes 14 made from an electrically conductive material (e.g., copper). The PCB substrate 12 may include multiple copper layers 16 (e.g., four layers) within the substrate to allow direct referencing for two-dimensional electrode arrays. For better performance, the PCB substrate 12 may be then lapped, polished by chemical-mechanical polishing (CMP), and a coating of dielectric 18 is deposited or otherwise applied. The dielectric layer 18 may include a 8000 Å layer of Parylene C. A hydrophobic coating 19 may be applied over of the dielectric layer 18. The hydrophobic coating 19 may include, for example, a 2000 Å layer of polytetrafluoroethylene (PTFE).

The EWOD chip 10 includes a top 20 that may be formed from a transparent material such as glass plate. Still referring to FIG. 1, the inner surface of the top 20 is coated with a conductive layer 22, such as transparent indium-tin-oxide (ITO), which acts as the ground electrode for the EWOD chip 10. The electrode layer 22 is coated with a hydrophobic layer 24. For example, the hydrophobic layer 24 may include a 2000 Å layer of PTFE.

Figure 9A:
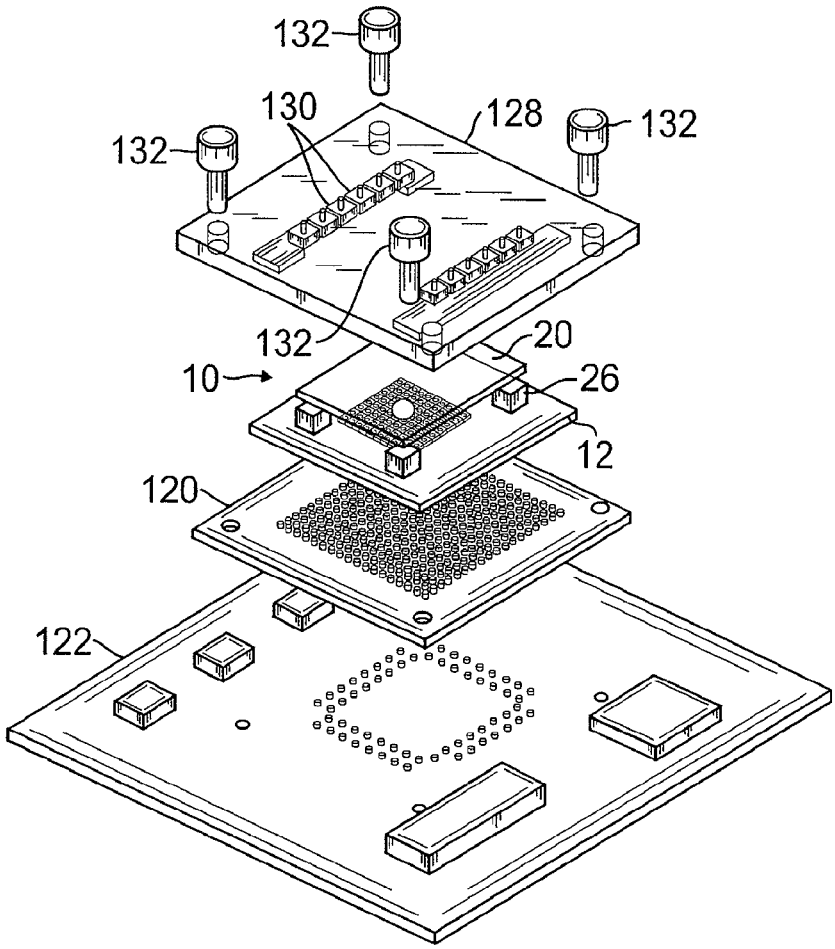
FIG. 9A illustrates a perspective view of a packaging scheme for an EWOD based device according to one embodiment.
Figure 9B:
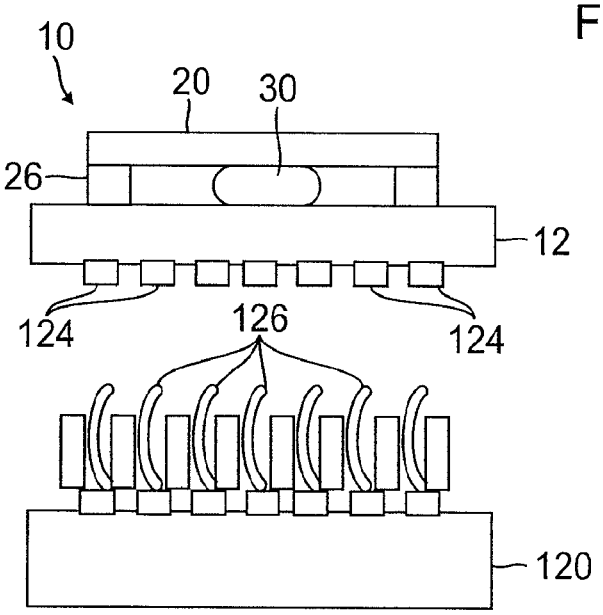
FIG. 9B illustrates a side view of a portion of the EWOD device illustrated in FIG. 9A.

Droplets 30 are then sandwiched between the bottom substrate 12 and the top 20 via spacers 26. The EWOD chip 10 is either exposed to gas or filled with another immiscible liquid such as oil. The oil may include a low viscosity silicone oil (1 cSt). Typical dimensions for the electrodes 14 in the EWOD chip 10 include 1 mm×1 mm electrode pads and a 100 μm thick spacer 26 between the substrate 12 and the top 20. The high aspect ratio of electrode size/spacer height (typically more than 10, e.g., 1.5 mm/0.1 mm=15) is chosen to meet the criteria for droplet 30 pinch off. As seen in FIG. 1, the EWOD chip 10 includes electrical contacts 28, 29 which may be used to apply voltages and measure droplet volume (described in more detail below). The electrical contacts 29 may electrically communicate with connection pads 124 (as seen in FIG. 9B) located on the substrate 12.

Figure 2A:
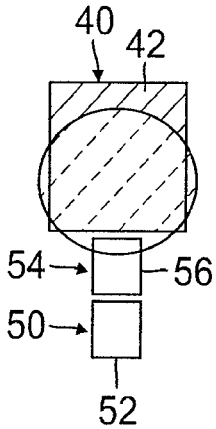
FIG. 2A illustrates a top-down schematic representation of a reservoir site, a droplet creation site, and a droplet separation site between them. The reservoir site includes an electrode, the droplet creation site includes an electrode, and the droplet separation site includes an electrode. Fluid is shown on the reservoir site electrode.

FIGS. 2A-2E illustrate top-down schematic representations of a reservoir site 40 and a droplet creation site 50 according to one embodiment. The reservoir site 40 includes a reservoir electrode 42, the droplet creation site 50 includes a droplet creation electrode 52, and the droplet separation site 54 includes a droplet separation electrode 56. It should be understood, however, that each site 40, 50, and 54 may have a single electrode or multiple electrodes. The reservoir site 40 may be relatively larger (e.g., 50× larger) than the droplet creation site 50 and the droplet separation site 54. As seen in FIG. 2A, the reservoir electrode 42 is energized (illustrated by hashing) by application of an electrical potential (either direct current (DC) or alternating current (AC)). The remaining electrodes 52, 56 are not energized and grounded. Depending on the particular algorithm used to generate droplets 30 the voltage may range from around 0 to around 200 V (AC or DC). Of course, these values are illustrative and other voltages and frequencies may be used consistent with the inventive concepts described herein. The reservoir site 40 may be configured to hold bulk liquid for forming a plurality of droplets. Alternatively, the reservoir site 40 may be configured to hold a single droplet that is then split using electrodes 52, 56 as described herein.

Figure 2B:
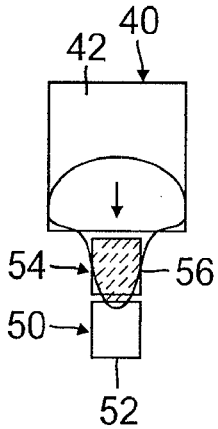
FIG. 2B illustrates the same device of FIG. 2A with the droplet separation site electrode being driven with an applied voltage. The fluid is shown being drawn onto the energized electrode in the direction of the arrow.
Figure 2C:
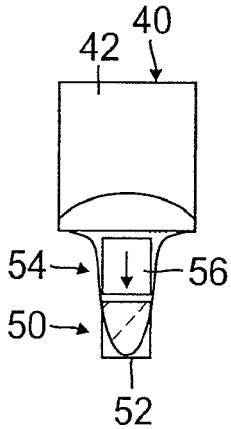
FIG. 2C illustrates the same device of FIG. 2A with the droplet creation site electrode as well as the separation site electrode being driven with an applied voltage. The fluid is shown being drawn onto the energized electrodes in the direction of the arrow.

FIG. 2B illustrates the separation electrode 56 of the droplet separation site 54 being energized. The reservoir electrode 42 is grounded in this state. The electrode 56 pulls fluid from the reservoir site 40 into the droplet separation site 54 in the direction of the arrow in FIG. 2B. Next, with reference to FIG. 2C, the fluid is pulled into the droplet creation site 50 by energizing the creation electrode 52. Additional fluid is then transferred in the direction of the arrow in FIG. 2C. This pre-filling process tends to reduce the dynamic competition between the pulling forces generated during the pinching or necking process when droplets 30 are formed. It should be understood, that the pre-filling step is optional and may be omitted.

Figure 2D:
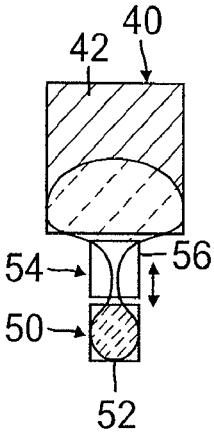
FIG. 2D illustrates the same device of FIG. 2A with both the reservoir site electrode and the droplet creation site electrode being driven with an applied voltage but not the separation site electrode. This causes the fluid to be pulled in both directions as illustrated by the double arrow. Eventually a droplet is pinched or split off from the fluid returning to the reservoir site.
Figure 2E:
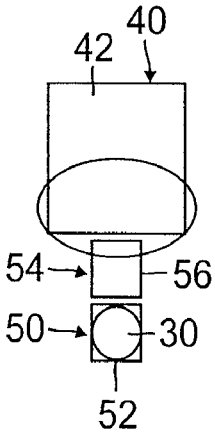
FIG. 2E illustrates the same device of FIG. 2A with the droplet being completely formed on the droplet creation site.

FIG. 2D illustrates a droplet 30 being created in a pinching or necking process. In this operation, both the reservoir electrode 42 and creation electrode 52 are energized. The separation electrode 56 is not energized at this stage and may be grounded. The electrode 42 is activated with a voltage which pulls a portion of the liquid back toward the reservoir site 40. The droplet 30 is created because the creation electrode 52 is also activated which acts to hold the liquid over the creation site 50. Ultimately, as the reservoir electrode 42 pulls fluid back to the reservoir site 40, a droplet neck forms (FIG. 2D) and a droplet 30 pinches off. It should be understood that the droplets 30 may be formed in air or in a carrier fluid such as oil or other carrier medium. It should also be understood that the droplets 30 in another fluid may be replaced by gas bubbles 30 in a liquid. FIG. 2E illustrates the fully formed droplet 30.

Figure 3:
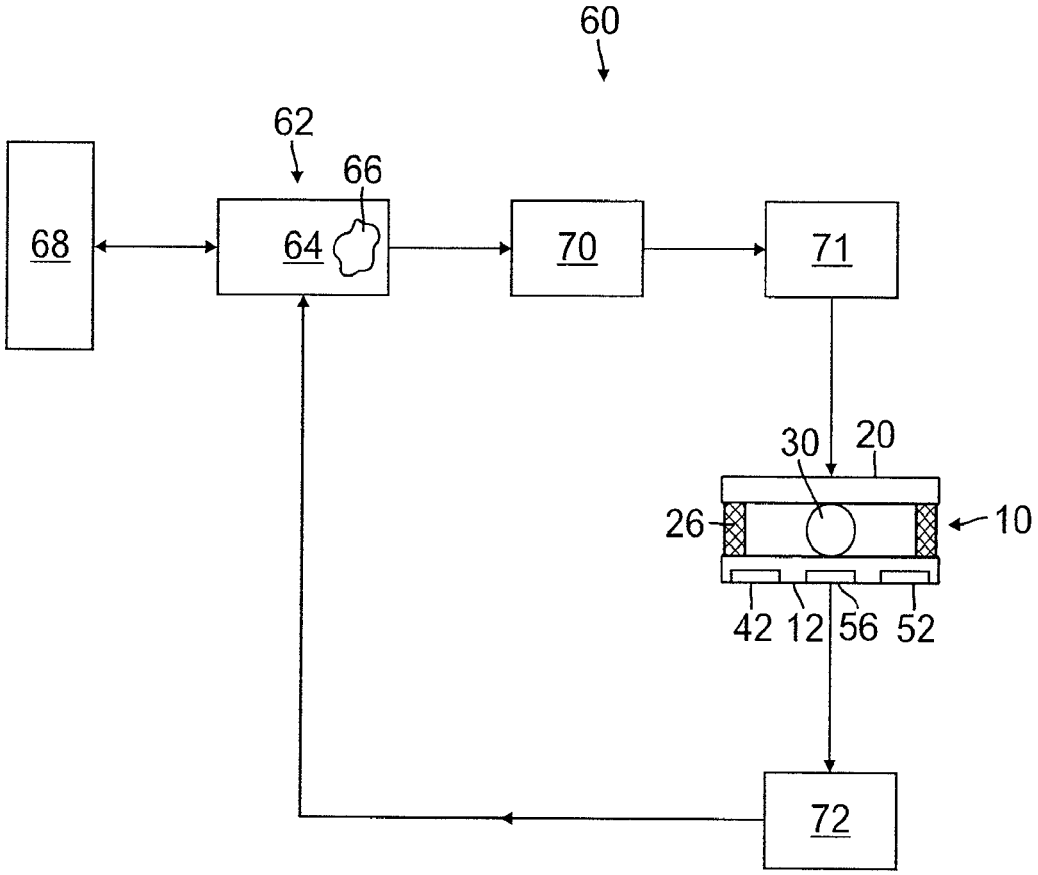
FIG. 3 illustrates a schematic representation of a feedback system for generating uniformly sized droplets in an EWOD device.

FIG. 3 illustrates a feedback control system 60 for generating droplets 30 having a uniform volume. The feedback control system 60 includes control circuitry 62 that is operatively coupled to the electrode(s) 42, 52, 56 in the reservoir site 40, droplet creation site 50, and droplet separation site 56, respectively. As explained below, the control circuitry 62 is configured to measure the capacitance of at least one of the electrodes 42, 52, 56 and can also independently adjust the applied voltage to the electrodes 42, 52, 56 based at least in part on the measured capacitance. Thus, the control circuitry 62 thus includes the dual functionality of driving the electrodes 42, 52, 56 in addition to measuring the capacitance of one or more electrodes 42, 52, 56 which is used as a proxy for droplet size.

As seen in FIG. 3, the control circuitry 62 includes a microcontroller 64 that is used to control the high voltage signals for EWOD actuation of the various electrodes 42, 52, and 56. The microcontroller 64 includes stored therein control logic 66 that contains the algorithm for determining the appropriate voltage(s) to be applied to the various electrodes 42, 52, 56 in response to the measured capacitance. The control logic 66 may include computer code or instructions that are downloadable to the microcontroller 64 via a separate computer 68. Various algorithms may be created, stored, or generated in the computer 68 for later download or transfer to the microcontroller 64. Transfer may be accomplished by any number of means known to those skilled in the art including direct transfer of instructions (e.g., over a wire, or storage device) or wirelessly. The microcontroller 64 may include, for instance, a MICROCHIP PIC18F452 running at 20 MHz.

Still referring to FIG. 3, the microcontroller 64 is operatively coupled to the digital-to-analog converter 70 (DAC) to output a low voltage analog signal. The DAC 70 may include, for example, a AD9736 14-bit DAC converter available from Analog Devices, Inc. The output of the DAC 70 is then input to a voltage amplifier 71. The voltage amplifier 71 may amplify the signals to between 20 and 300 V. The voltage amplifier 71 may include, by way of example, a 32-channel SUPERTEX HV257 sample and hold amplifier array integrated circuit available from SUPERTEX, Inc. set with 72 V/V amplifier gain. The amplified voltage signals can then selectively and independently be applied to the electrodes 42, 52, 56 on the EWOD device 10 by continually selecting 32 amplifier channels one-by-one. For instance, reservoir electrode 42 may be driven at +80 V while the separation electrode 56 and creation electrode 52 are not driven (0 V).

Figure 4:
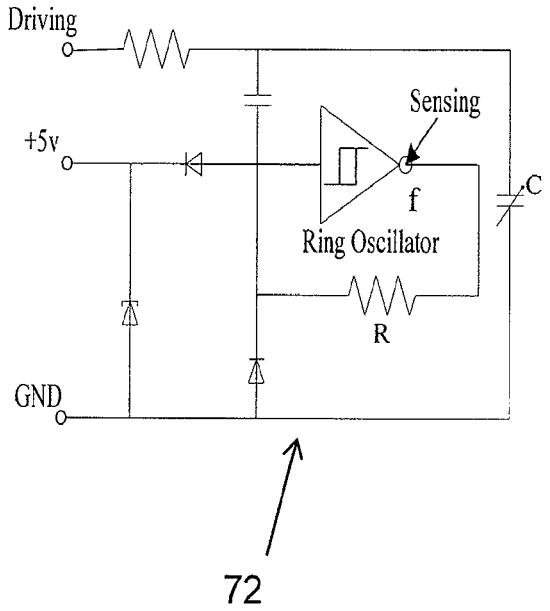
FIG. 4 illustrates a ring oscillator circuit according to one aspect of the invention.

As explained above, the control circuitry 62 includes the ability to measure the capacitance of any electrodes but most typically the creation electrode 52. In one aspect, a ring oscillator circuit 72 is used to measure this capacitance. FIG. 4 illustrates the layout of a ring oscillator circuit 72 whose oscillation frequency changes in response to capacitance changes. The ring oscillator circuit 72 may be built on a MM74C14 Hex Schmitt Trigger available from Fairchild Semiconductor Corporation. The EWOD device 10 is coupled with an oscillation circuit with a capacitor to isolate the high voltage (e.g., +80 V) DC signal and allow the low voltage (e.g., +5 V) high frequency sensing signal to pass. The oscillation frequency range can be modulated by changing the resistance R of the ring oscillator circuit 72 to ensure high measurement resolution. A multiplexer (not shown) may be used to select the electrode 52 for measurement. The output of the ring oscillator circuit 72 is input to a counter port on the microcontroller 64. The counter port of the microcontroller 64 counts the frequency generated by the ring oscillator circuit 72. For an oscillation frequency of between 1-3 MHz, the pulse counter receives between 1000 and 3000 pulses in a 1 ms duration. Advantageously, the speed of the microcontroller 72 and the voltage amplifier 71 is such that one feedback cycle may finish within around 1 ms. In this regard, the feedback cycle results in real-time or substantially real-time control.

The control circuitry 62 may be integrated onto a common circuit board or the like that may be integrated with the EWOD chip 10. For example, a small PCB (e.g., 5" by 7") or the like may contain the control circuitry 62 and, optionally, the EWOD chip 10. Control logic 66 may be downloaded from the computer 68 to the control circuitry 62 via a wired or wireless connection. Data and other parameters (e.g., voltage, capacitance, etc.) may be communicated from the control circuitry 62 back to the computer 68 for later, processing, manipulation, and display.

Figure 5:
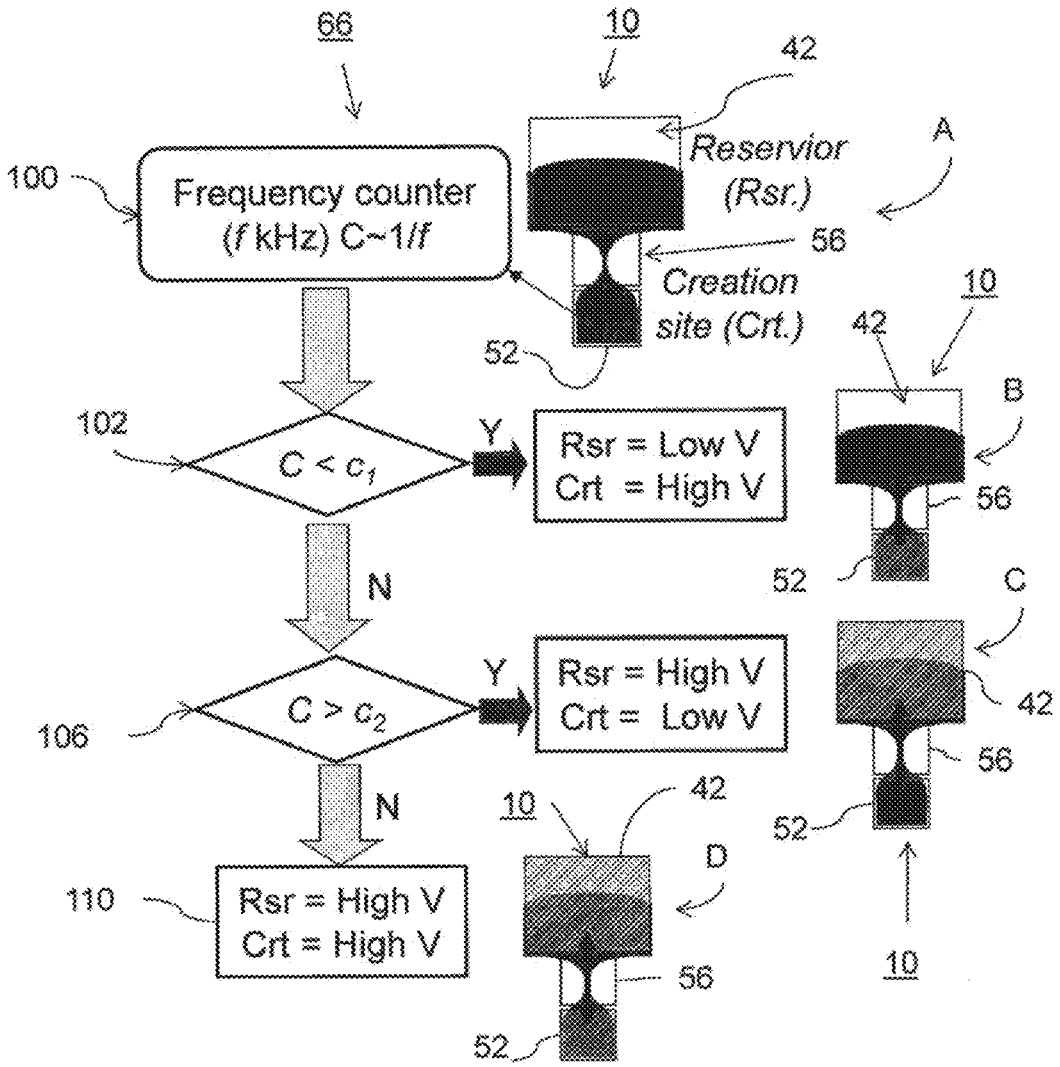
FIG. 5 illustrates one exemplary control algorithm that may be used to generate droplets according to one embodiment of the invention.

FIG. 5 illustrates one algorithm or control logic 66 that may be utilized in the EWOD device 10. FIG. 5 illustrates the reservoir electrode 42, separation electrode 56, and creation electrode 52 similar to that illustrated in FIGS. 2A-2E. For example, droplet necking is shown (state A) occurring as fluid is pulled back toward the reservoir electrode 42 from the creation electrode 52. In step 100, the output frequency from the ring oscillator circuit 72 is obtained by counting pulses. The frequency or pulse count is a proxy or parameter indicative of the measured capacitance of the creation electrode 52. For example, the measured or observed capacitance (C) is related to frequency (f) according to the following formula $$C \sim 1/f \qquad \text{Eq. 1}$$

Next, in step 102, the measured capacitance (C) is compared against a first, predefined threshold capacitance $C_1$. If the measured capacitance (C) is lower than the predefined threshold capacitance $C_1$, then the creation electrode 52 is energized with a high voltage while the reservoir electrode 42 is not energized (0 V) or energized with a low voltage (step 104). When the measured capacitance (C) is lower than the predefined threshold capacitance $C_1$, this indicates that the volume of the putative droplet 32 is below a lower limit. When a high voltage is applied to the creation electrode 52, this tends to draw or pull more fluid toward the creation electrode 52 as illustrated in the state B of the EWOD device 10 in FIG. 5. For example, the reservoir electrode 42 may be set to ground or 0 V while the creation electrode 52 is energized at 90 V. The count frequency (f) is monitored (step 100) and the comparison of the measured capacitance (C) with the predefined threshold capacitance $C_1$ is performed (step 102). If the measured capacitance (C) is greater than the predefined threshold capacitance $C_1$, then another comparison step is performed (step 106).

In step 106, the measured capacitance (C) is compared with a second predefined threshold capacitance $C_2$. If the measured capacitance (C) is greater than the second predefined threshold capacitance $C_2$, this indicates that the putative droplet 30 will be larger than the upper limit. In this case, the creation electrode 52 is not energized (0 V) or energized with a low voltage while the reservoir electrode 42 is energized with a high voltage (step 108). For example, the creation electrode 52 may be set to ground or 0 V while the reservoir electrode 42 is energized at 80 V. This action tends to draw fluid back to the reservoir site 40 making the droplet 30 smaller. This is seen in EWOD device 10 in state C.

If the measured capacitance (C) is within the first and second predefined threshold capacitances $C_1$, $C_2$, then the droplet 30 is at a target size, and both the reservoir electrode 42 and the creation electrode 52 are energized with a high voltage so as to initiate neck breaking to form a separate droplet 30 (step 110). By applying a high voltage to both the reservoir electrode 42 and the creation electrode 52, the neck-portion of the fluid is broken because of the opposing forces (state D). For example, the reservoir electrode 42 may be driven at 80 V while the creation electrode 52 is driven at 90 V, while the separation electrode 56 is grounded at 0 V.

Figure 6A:
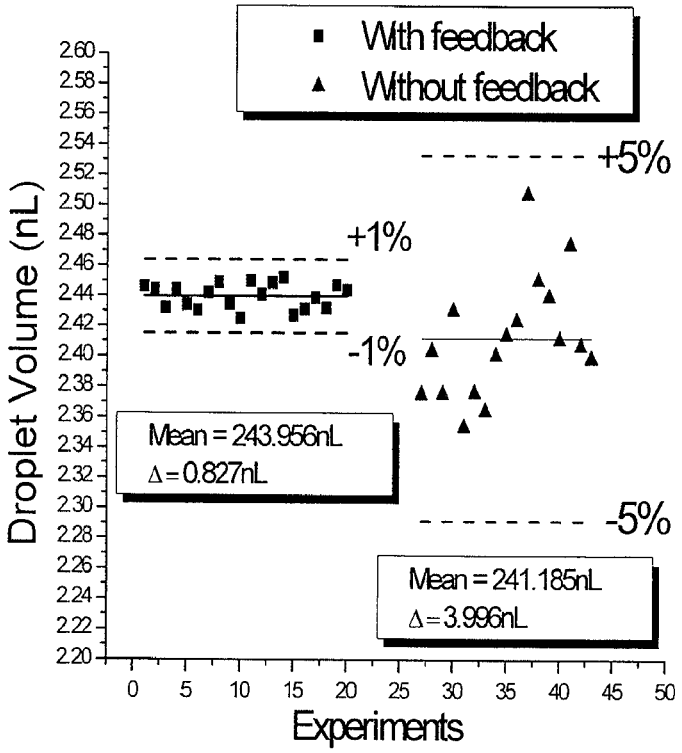
FIG. 6A illustrates a scatter plot of the generated droplet volume for a series of experiments conducted without feedback and with feedback.
Figure 6B:
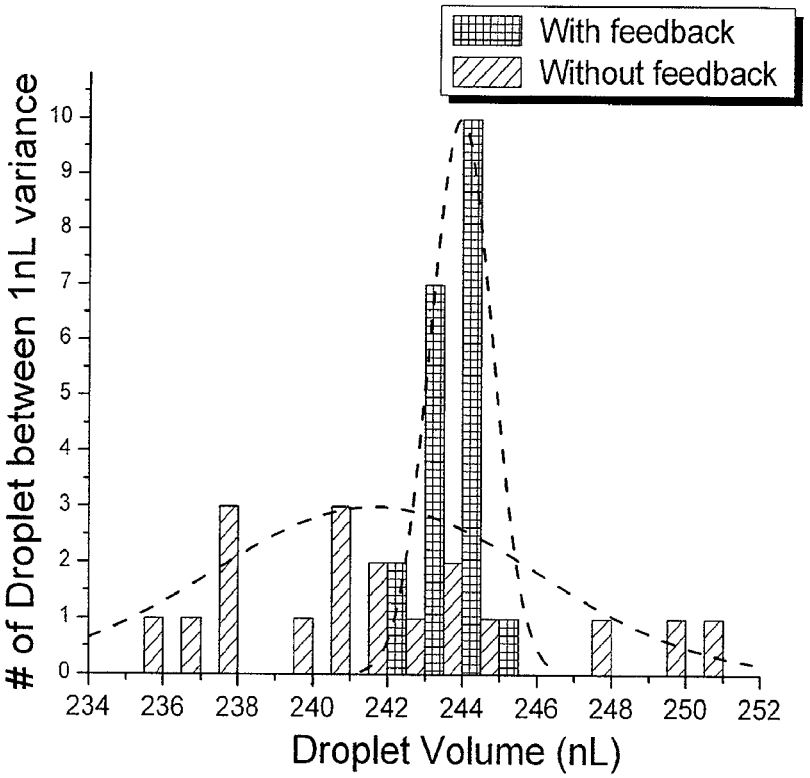
FIG. 6B illustrates a histogram of droplet volume for the experiments conducted without feedback and with feedback.

FIGS. 6A and 6B graphically illustrate the ability of the feedback control system 60 to create droplets 30 having substantially uniform volumes. FIG. 6A illustrates a scatter plot of the generated droplet volume for a series of experiments conducted without feedback and with feedback. FIG. 6B illustrates a histogram of droplet volume for the experiments conducted without feedback and with feedback. As seen in FIG. 6A, when feedback was employed the generated droplets fell within a tight range (less than +/−1%) having a mean of 243.956 nL with a standard deviation of 0.827 nL. When feedback was not employed, the generated droplets had a larger variation in volumes (mean of 241.185 nL with a standard deviation of 3.996 nL). The standard deviation of the droplet volume distribution was five times smaller with feedback control as compared to no feedback control. The tight distribution of volumes when feedback was employed can also be seen in the histogram of FIG. 6B.

In another embodiment of the invention, the size of volume of the generated droplets 30 may be adjusted by the user. For example, user-prescribed volumes of droplets 30 on a given electrode pattern may be achieved by changing the controlled droplet volume range (i.e., $C_1$ and $C_2$). Because of the excellent linear relationship between the volume of the droplet 30 and the measured capacitance (C), the desired volume(s) may be achieved to selecting the appropriate capacitance set points. The feedback control system 60 and EWOD device 2 described herein is capable of generating droplets 30 that are as small as 20% of the size of the creation electrode 52.

For example, user-prescribed volumes of droplets 30 is particularly important for dilution and mixing applications. For example, it is desirable to control the volume of droplets 30 on a given microfluidic device so that different droplets 30 or fluid packets may be mixed or diluted in one another in various ratios. With the ability to more accurately generate droplet volumes within a wide range, more sophisticated microfluidic operations can be designed, allowing new microfluidic operations not feasible before such as fast high-order dilution on droplet microfluidic platforms.

As one example, for a ×10000 dilution without feedback control, the most efficient method to achieve this is 1:1 mixing and cutting, requiring 14 operations cycles. By using feedback with variable control of droplet volume, only six cycles are needed to achieve the same dilution level. Not only does fewer dilution cycles increase efficiency, there is improved concentration accuracy with a smaller accumulated error.

Figure 7A:
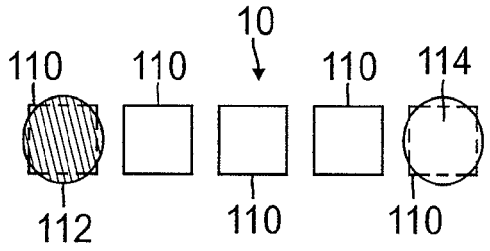
FIGS. 7A-7D illustrate an EWOD device and process used for dilution or mixing of differing fluids.

FIGS. 7A-7D illustrate an EWOD device 10 that is used for dilution or mixing of fluids. In this embodiment, the device 10 includes a plurality of electrodes 110 that can be individually driven with a drive voltage. The capacitance levels at each electrode 110 may also be measured as described herein. The device 10 of FIGS. 7A and 7B includes first and second solutions 112, 114 that are used as source solutions to prepare the diluted mixture. For example, the first solution 112 may include a solution that is to be diluted (e.g., concentrated solution) while the second solution 114 may include a buffer. FIG. 7A illustrates the first solution 112 on one of the electrodes 110 while the second solution 114 is on an opposing electrode 110. While five such electrodes 110 are illustrated in FIGS. 7A-7D, there may be more of fewer (e.g., three or more).

Figure 7B:
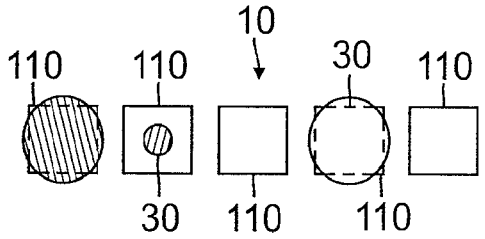

Dilution is effectuated in a number of cycles in which droplets 30 formed from the first and second solutions 112, 114 are merged with one another. FIG. 7B illustrates the ability of the feedback control to dilute differing volumes of solutions 112, 114. For example, as seen in FIG. 7B, the droplet 30 of the first, concentrated solution 112 is much smaller than the droplet 30 of the buffer solution 114. The droplet 30 indeed may be bigger, a volume that is multiple of an electrode. Rather than conventional 1:1 or N:M dilution schemes, N and M being integers representing N and M times the size of the electrodes, the device 10 operates by N:X dilution, N being an integer and X being a fraction of 1, because the volume of the first and/or second solutions 112, 114 may be independently controlled.

Figure 7C:
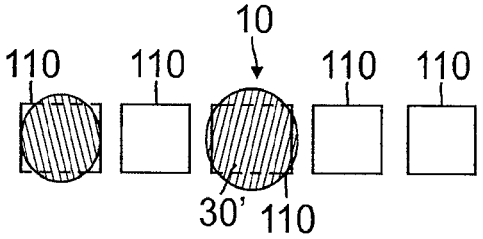
Figure 7D:
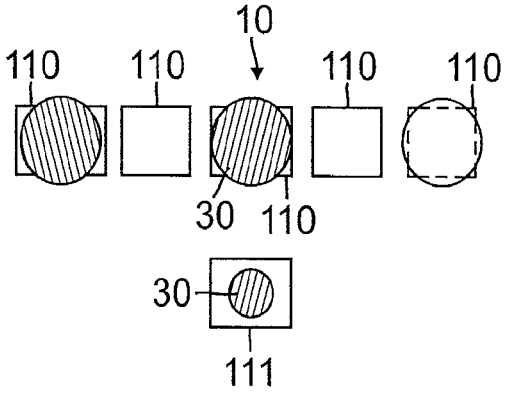

In FIG. 7C, the smaller droplet 30 of the first solution 112 is merged or combined with the larger droplet 30 from the second solution 114 to form a larger merged or combined droplet 30'. This merged droplet 30' is then split or divided to reduce its volume. For example, as illustrated in FIG. 7D, an extra electrode 111 is located adjacent to the center electrode 110 and can be used to split the droplet 30' into two smaller droplets 30 as illustrated in FIG. 7D. The dilution process may continue for a number of additional cycles until the desired threshold is reached. Because a relatively small droplet 30 of the first solution 112 is diluted with a relatively larger droplet 30 of the second solution 114, and this process may be repeated a number of times, fewer cycles are needed to achieve the desired dilution factor. This has several advantages. First, there is less waste of reagents (e.g., buffer) because the number of cycles has been reduced. In addition, the cumulative error is reduced because there are fewer dilution cycles. In addition, because the feedback system is used, there is less error per cycle compared with conventional 1:1 dilution. This further reduces the cumulative error.

In prior dilution schemes, the size of the droplet that was created was fixed and determined by the underlying size of the electrode. By using the feedback system described herein, the volumes of the first and/or second solutions 112, 114 may be adjusted. By reducing the size of the concentrated droplet 30 using the feedback system, the number of cycles required to achieve the desired dilution threshold is reduced.

It should be understood that a variety of feedback control logic schemes can be used in connection with the feedback control system 60. For instance, proportional, proportional-integral, or proportional-integral-derivative (PID) control may be used to improve the dynamic response of the feedback control system 60. In this regard, the algorithm like the one illustrated in FIG. 5 is not used. In one example, a discrete time PID control algorithm may be used according the following control algorithm where $\text{Output}_n$ is the output voltage at time ($T_n$), $e_n$ is the error of sensing data to target $T_n$ (i.e., $C_T-C_n$), $K_p$ is the proportional coefficient, and $K_d$ is the derivative coefficient. The proportional coefficient $K_p$ and the derivative coefficient $K_d$ are determined empirically. The integral coefficient ($K_i$) is always kept at 1 to ensure the feedback control system 60 remains stable. The PID algorithm may be calculated as follows:

$$\text{Output}_{n+i}=\text{Output}_n+K_p e_n+K_d(e_n-e_{n-1}) \quad \text{Eq. 2}$$

Figure 8A:
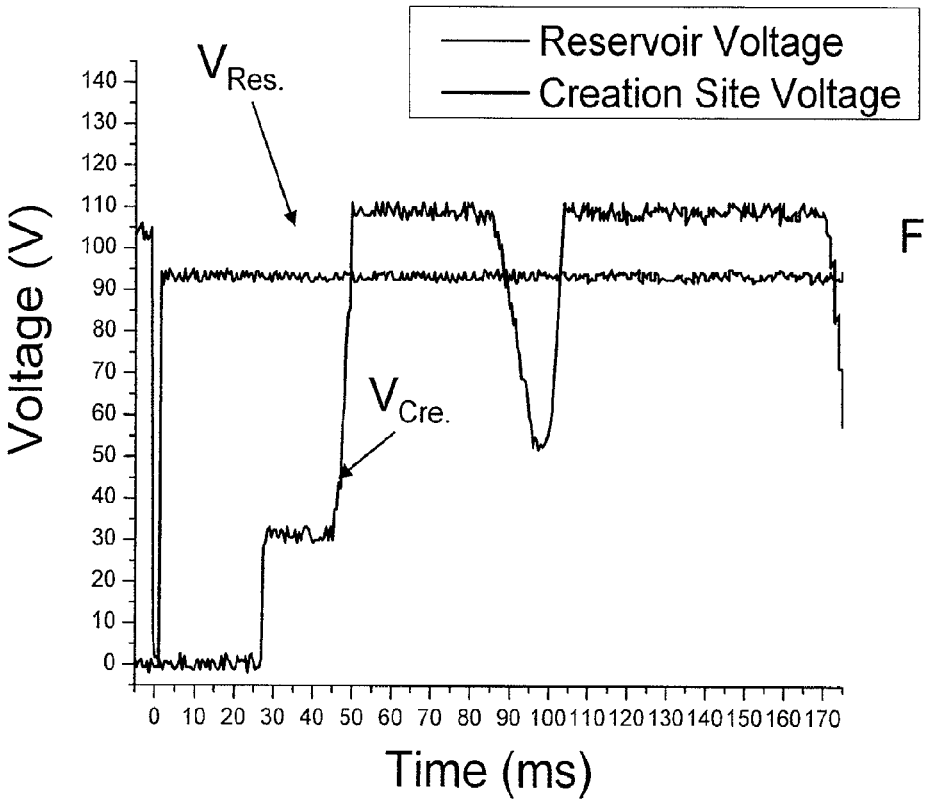
FIG. 8A illustrates a graph of the applied voltage as a function of time for the reservoir electrode and the creation electrode during the droplet necking process.
Figure 8B:
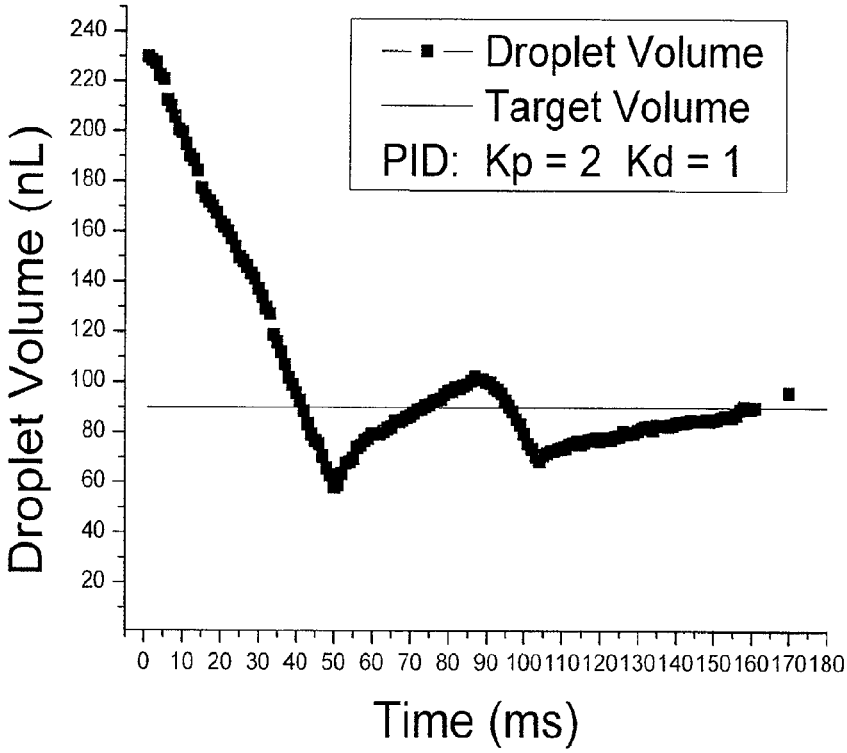
FIG. 8B illustrates a graph of the droplet volume (nL) as a function of time (the same time period as illustrated in FIG. 8A).

FIG. 8A illustrates a graph of the applied voltage as a function of time for the reservoir electrode 42 ($V_{Res.}$) and the creation electrode 52 ($V_{Cre.}$) during the droplet necking process. As seen in FIG. 8A, the reservoir electrode 42 is maintained at a constant voltage while the driving voltage of the creation electrode 52 is varied. FIG. 8B illustrates a graph of the droplet volume (nL) over the same time period. A line showing the target volume (~90 nL) is also illustrated in FIG. 8B. As seen in FIGS. 8A and 8B, when the volume of the droplet 30 falls below the target volume (e.g., when measured capacitance drops below target capacitance value), the applied voltage to the creation electrode 52 is increased. This causes additional fluid to be drawn toward the creation electrode 52 and thus increase the volume of the putative droplet 30. When the volume of the droplet 30 is above the target level (as illustrated in FIG. 8B), the voltage of the creation electrode 52 is reduced (as shown by drop in voltage at ~100 ms) so as to reduce the droplet volume. This back-and-forth during the necking or pinching process continues until the neck breaks so as to form a physically separate droplet 30.

As explained above, the feedback control system 60 may be integrated with the EWOD device 10 so that a single, small device may be used. In one embodiment, as illustrated in FIGS. 9A and 9B, a land grid array (LGA) socket 120 mounted on a control board 122 is used to interface with the EWOD device 10. In particular, as seen in FIG. 9B, the PCB substrate 12 has a plurality of contact pads 124 located on the underside of the substrate 12 that engage with vertically-oriented contact members 126 on the LGA socket 120. These vertically-oriented contact members 126 may include spring-biased pins or the like. A pressure lid 128 containing loading reservoirs 130 may be secured to the EWOD device 10 using a number of fasteners or the like 132.

In this embodiment, the EWOD device 10 serves not only to carrier the microfluidic chip but also as the packaging carrier for the control circuitry 62. This scheme eliminates the need for electrical connections in packaging, i.e., wire bonding for glass or Silicon EWOD-based devices.

The present device and method offers a number of improvements over prior attempts at feedback control. First, there is improved precision in creating droplets 30 having substantially uniform volumes (+/−1%). The real-time feedback control may be used on a wide range of fluids, and the particular volume of generated droplets 30 may be user-controlled. The system also permits more accurate and efficient sample dilution and mixing. These improvements may also be realized without sacrificing system portability as there is no need for any external, bulky components like pumps or the like.

While embodiments of the present invention have been shown and described, various modifications may be made without departing from the scope of the present invention. The invention, therefore, should not be limited, except to the following claims, and their equivalents.

What is claimed is:

1. A device for generating droplets comprising:

a substrate comprising a reservoir site configured to hold a liquid and comprising a first electrode, a droplet creation site comprising a second electrode, and a droplet separation site comprising a third electrode disposed between the reservoir site and the droplet creation site, wherein the first electrode is larger than the second electrode and third electrode;

control circuitry operatively coupled to the second electrode, the control circuitry configured to repeatedly measure capacitance at the second electrode, the control circuitry further being configured to compare the measured capacitance to a first threshold value $C_1$ and a second threshold value $C_2$, wherein when the measured capacitance is below the first threshold value the control circuitry applies a high voltage to the second electrode and a low or zero voltage to the first electrode, and wherein the measured capacitance is above the first threshold value $C_1$ and the second threshold value $C_2$, the control circuitry applies a low or zero voltage to the second electrode and a high voltage to the first electrode, and wherein the measured capacitance is above the first threshold value $C_1$ and below the second threshold value $C_2$, the control circuitry applies a high voltage to the second electrode and a high voltage to the first electrode.

2. The device of claim 1, wherein the first electrode is at least fifty times larger than the second electrode.

3. The device of claim 1, wherein the control circuitry comprises a ring oscillating circuit.

4. The device of claim 3, further comprising a microcontroller operatively coupled to an output of the ring oscillating circuit.

5. The device of claim 4, wherein the microcontroller is operatively coupled to a voltage control circuit, the voltage control circuit being operatively coupled to a voltage amplifier coupled at least to the first and second electrodes.

6. The device of claim 1, wherein the at least one of the reservoir site, droplet creation site, and droplet separation site comprise a plurality of electrodes.

7. The device of claim 5, wherein the first threshold value $C_1$ and the second threshold value $C_2$ are stored within the microcontroller.

8. The device of claim 1, wherein the high voltage comprises a voltage of at least 80V.

* * * * *